US011140499B2

(12) United States Patent
Giri et al.

(10) Patent No.: US 11,140,499 B2
(45) Date of Patent: Oct. 5, 2021

(54) ACCOUSTIC FEEDBACK PATH MODELING FOR HEARING ASSISTANCE DEVICE

(71) Applicant: Starkey Laboratories, Inc., Eden Prairie, MN (US)

(72) Inventors: Ritwik Giri, San Diego, CA (US); Fred Mustiere, Chaska, MN (US); Tao Zhang, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 280 days.

(21) Appl. No.: 16/332,437

(22) PCT Filed: Sep. 12, 2017

(86) PCT No.: PCT/US2017/051187
§ 371 (c)(1),
(2) Date: Mar. 12, 2019

(87) PCT Pub. No.: WO2018/049405
PCT Pub. Date: Mar. 15, 2018

(65) Prior Publication Data

US 2021/0144494 A1 May 13, 2021

Related U.S. Application Data

(60) Provisional application No. 62/393,452, filed on Sep. 12, 2016.

(51) Int. Cl.
*H04R 25/00* (2006.01)

(52) U.S. Cl.
CPC ..... *H04R 25/70* (2013.01); *H04R 25/453* (2013.01); *H04R 25/505* (2013.01)

(58) Field of Classification Search
CPC ..... H04R 25/70; H04R 25/453; H04R 25/505
See application file for complete search history.

(56) References Cited

U.S. PATENT DOCUMENTS 6,072,884 A 6/2000 Kates
2017/0094421 A1 3/2017 Giri et al.

OTHER PUBLICATIONS

International Search Report and Written Opinion from PCT Application No. PCT/US2017/051187 dated Dec. 1, 2017, 14 pages.

(Continued)

*Primary Examiner* — Matthew A Eason
(74) *Attorney, Agent, or Firm* — Mueting Raasch Group

(57) ABSTRACT

A system and method of determining a filter to cancel feedback signals from input signals in a hearing assistance device includes determining feedback signals for a plurality of feedback paths associated with the device, and determining a model of the plurality of feedback paths, with the model having an invariant portion and a time varying portion. A probable structure of the invariant portion is determined to generate a structural constraint to constrain the plurality of feedback paths, and probability distributions to impose the structural constraint on the invariant portion are determined. During an iterative process, the invariant portion is iteratively determined using the determined probability distributions and the feedback path measurements. A measurement noise variance representative of model mismatch is updated, for each iteration, to reduce a probability of a non-desirable determination of an invariant filter, and the invariant filter is determined in response to a criterion for ending the iterative process being satisfied.

22 Claims, 5 Drawing Sheets

(56) References Cited

OTHER PUBLICATIONS

Bishop et al., "Blind Image Deconvolution: Problem Formulation and Existing Approaches", Blind Image Deconvolution: Theory and Applications, 2007, pp. 1-41.
Fergus et al., "Removing Camera Shake from a Single Photograph", ACM Transactions on Graphics, vol. 25, 2006, pp. 787-794.
Giri et al., "Dynamic Relative Impulse Response Estimation Using Structured Sparse Bayesian Learning", IEEE International Conference on Acoustics, Speech and Signal Processing, IEEE, Mar. 20, 2016, pp. 514-518.
Giri et al., "Bayesian Blind Deconvolution with Application to Acoustic Feedback Path Monitoring", 2017 IEEE International Conference on Acoustics, Speech and Signal Processing, Mar. 2017, pp. 601-605.
Giri et al., "Type I and Type II Bayesian Methods for Sparse Signal Recovery Using Scale Mixtures", IEEE Transactions on Signal Processing, vol. 64, No. 13, 2016, pp. 3418-3428.
Haykin, "Adaptive Filter Theory", Pearson Education India, 2008.
Krisfinan et al., "Blind Deconvolution Using a Normalized Sparsity Measure", Computer Vision and Pattern Recognition, IEEE, 2011, pp. 233-240.
Levin et al., "Efficient Marginal Likelihood Optimization in Blind Deconvolution", Computer Vision and Pattern Recognition, IEEE, 2011, pp. 2657-3664.
Lin et al., "Bayesian L1-Norm Sparse Learning", Acoustics, Speech and Signal Processing, ICASSP 2006 Proceedings, Jan. 2006, pp. V.
Liu et al., "The Annealing Sparse Bayesian Learning Algorithm", Sep. 5, 2012.
Ma et al., "Extracting the Invariant Model from the Feedback Paths of Digital Hearing Aids", The Journal of the Acoustical Society of America, vol. 130, No. 1, Jul. 2011, pp. 350-363.
Ma et al., "Adaptive Feedback Cancellation with Band-Limited LPC Vocoder in Digital Hearing Aids", IEEE Transactions on Audio, Speech, and Language Processing, vol. 19, No. 4, 2011, pp. 677-687.
Maxwell et al., "Reducing Acoustic Feedback in Hearing Aids", IEEE Transactions on Speech and Audio Processing, vol. 3, No. 4, 1995, pp. 304-313.
Sayed, "Fundamentals of Adaptive Filtering", John Wiley & Sons, 2003.
Schepker et al., "Modeling the Common Part of Acoustic Feedback Paths in Hearing Aids Using a Pole-Aero Model", in 2014 IEEE International Conference on Acoustics, Speech and Signal Processing, IEEE, 2014, pp. 3665-3669.
Schepker et al., "Least-Squares Estimation of the Common Pole-Zero Filter of Acoustic Feedback Paths in Hearing Aids", IEEE/ACM Transactions on Audio, Speech and Language Processing, IEEE, vol. 24, No. 8, Aug. 2016, pp. 1334-1347.
Spriet et al., "Adaptive Feedback Cancellation in Hearing Aids", Journal of the Franklin Institute, vol. 343, No. 6, 2006, pp. 545-573.
Spriet et al., "Feedback Control in Hearing Aids", Springer Handbook of Speech Processing, 2008, pp. 979-1000.
Tipping, "Sparse Bayesian Learning and the Relevance Vector Machine", Journal of machine Learning Research, vol. 1, Sep. 2001, pp. 211-244.
Wipf et al., "Revisiting Bayesian Blind Deconvolution", Journal of Machine Learning Research, vol. 15, Nov. 2014, pp. 3775-3814.

Tail Behavior: Student's t vs Gaussian

ACCOUSTIC FEEDBACK PATH MODELING FOR HEARING ASSISTANCE DEVICE

CROSS-REFERENCE TO RELATED APPLICATION

This application is the § 371 U.S. National Stage of International Application No. PCT/US2017/051187, filed Sep. 12, 2017, which claims the benefit of U.S. Provisional Application No. 62/393,452, filed Sep. 12, 2016, the disclosures of which are incorporated by reference herein in their entireties.

TECHNICAL FIELD

This disclosure relates generally to hearing assistance devices and more particularly to acoustic feedback path modeling for hearing assistance devices.

BACKGROUND

Hearing assistance devices, such as hearing aids, can be used to assist patients suffering hearing loss by transmitting amplified sounds to one or both ear canals. In one example, a hearing aid can be worn in and/or around a patient's ear. Acoustic feedback in digital hearing aids usually occurs because of the coupling between the receiver, i.e., the speaker and the hearing aid microphone, which results in distortion of the desired sound and can lead to whistling sounds. Such whistling sounds have become a common problem associated with the current generation of digital hearing aids and therefore efficient strategies to prevent the howling sounds are desirable to reduce distortion of the desired sound and control whistling.

Current approaches to address acoustic feedback have included using feedback cancellation (FC) algorithms. Such algorithms typically estimate the feedback signal and remove it from the hearing aid microphone signal to make sure that only the desired speech signal is amplified in the forward path. Because feedback paths may change due to the dynamic nature of the acoustic surrounding/environment, an adaptive feedback cancelation (AFC) approach has been proposed where the impulse response (IR) between the receiver and the hearing aid microphone is estimated using an adaptive filter. In traditional AFC algorithms a finite impulse response (FIR) is used to model the adaptive feedback path, which may often lead to a very long filter to model the FBP depending on different acoustic variabilities. In addition, the convergence speed and the computational complexity of the adaptive filter is determined by the number of adaptive filter coefficients, which makes such an approach less effective. Therefore, solutions that involve far less adaptive parameters to model the feedback path are more desirable.

SUMMARY

In general, the present disclosure provides a method and system for determining a filter to cancel feedback signals from input signals in a hearing assistance device. The method and system use acoustic feedback paths measured on human subjects to account for individual ear geometries and to track time-varying feedback paths, e.g., due to the subject moving in the acoustic field. In one embodiment, a method of determining a filter to cancel feedback signals from input signals in a hearing assistance device includes determining feedback signals for a plurality of feedback paths associated with the device, determining a model of the plurality of feedback paths, the model comprising an invariant portion and a time varying portion, and determining a probable structure of the invariant portion to generate a structural constraint to constrain the plurality of feedback paths. Probability distributions to impose the generated structural constraint on the invariant portion are determined, and the invariant portion is iteratively determined, during an iterative process, using the determined probability distributions and the feedback path measurements. For each iteration, a measurement noise variance representative of model mismatch is updated to reduce a probability of a suboptimal, or non-desirable determination of an invariant filter, and the invariant filter is determined in response to a criterion for ending the iterative process being satisfied.

In one aspect, the present disclosure provides a system of determining a filter to cancel feedback signals from input signals that includes a hearing assistance device for processing acoustics signals, and a processor. The processor is configured to determine feedback signals for a plurality of feedback paths associated with the device, determine a model of the plurality of feedback paths, the model comprising an invariant portion and a time varying portion, determine a probable structure of the invariant portion to generate a structural constraint to constrain the plurality of feedback paths, determine probability distributions to impose the structural constraint on the invariant portion, iteratively determine, during an iterative process, the invariant portion using the determined probability distributions and the feedback path measurements, update, for each iteration, a measurement noise variance representative of model mismatch, to reduce a probability of a suboptimal or non-desirable determination of an invariant filter, and determine the invariant filter in response to a criterion for ending the iterative process being satisfied.

All headings provided herein are for the convenience of the reader and should not be used to limit the meaning of any text that follows the heading, unless so specified.

The term "comprises" and variations thereof do not have a limiting meaning where the term appears in the description and claims. Such term will be understood to imply the inclusion of a stated step or element or group of steps or elements but not the exclusion of any other step or element or group of steps or elements.

The words "preferred" and "preferably" refer to embodiments of the disclosure that may afford certain benefits, under certain circumstances; however, other embodiments may also be preferred, under the same or other circumstances. Furthermore, the recitation of one or more preferred embodiments does not imply that other embodiments are not useful, and is not intended to exclude other embodiments from the scope of the disclosure.

In this application, terms such as "a," "an," and "the" are not intended to refer to only a singular entity, but include the general class of which a specific example may be used for illustration. The terms "a," "an," and "the" are used interchangeably with the term "at least one." The phrases "at least one of" and "comprises at least one of" followed by a list refers to any one of the items in the list and any combination of two or more items in the list.

As used herein, the term "or" is generally employed in its usual sense including "and/or" unless the content clearly dictates otherwise.

The term "and/or" means one or all of the listed elements or a combination of any two or more of the listed elements.

These and other aspects of the present disclosure will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Throughout the specification, reference is made to the appended drawings, where like reference numerals designate like elements, and wherein.

DETAILED DESCRIPTION

Figure 1:
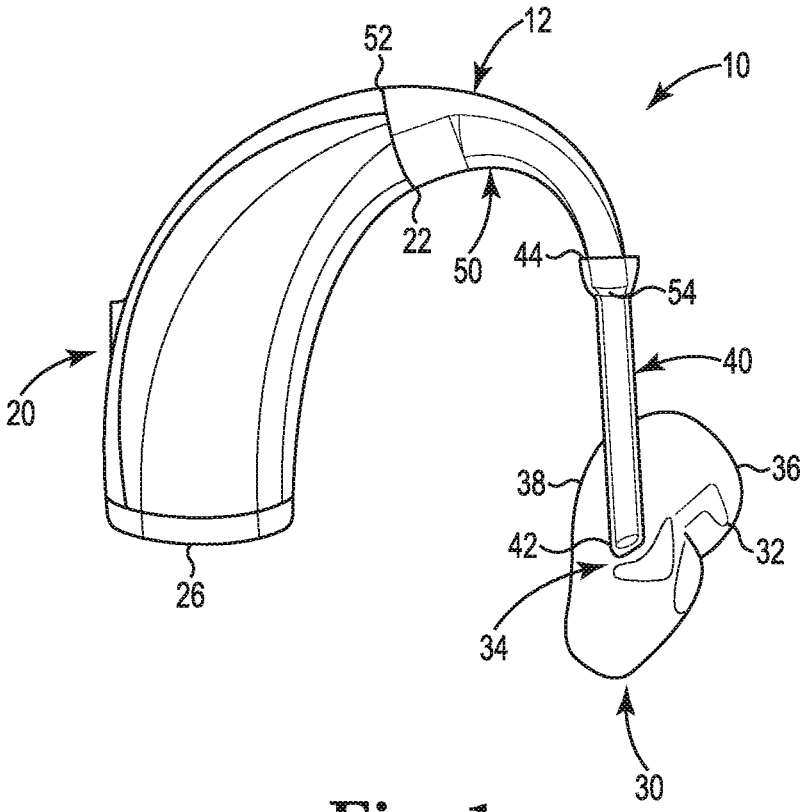
FIG. 1 is a schematic perspective view of one embodiment of a hearing assistance device.

The present disclosure describes a method and system for determining a filter to cancel feedback signals from input signals in a hearing assistance device. Hearing aids are one type of a hearing assistance device. Other hearing assistance devices include, but are not limited to, those in this disclosure. It is understood that their use in the disclosure is intended to demonstrate the present subject matter but not in a limited, exclusive, or exhaustive sense. It is desirable to use acoustic feedback paths measured on human subjects to account for individual ear geometries and to track time-varying feedback paths, e.g., due to the subject moving in the acoustic field. In a direct measurement procedure, the sound pressure is generated by the hearing aid receiver in the ear canal and recorded with the hearing aid microphone located outside of the ear, to measure the corresponding feedback path (FBP).

In the present disclosure, the acoustic signal of a feedback path is modeled as the convolution of two filters: a time invariant or common portion, which corresponds to the intrinsic properties of a specific hearing aid (transducer characteristics) and also individual ear characteristics, and a time varying variable portion which enables the dynamic nature of the acoustic environment (e.g., caused by moving objects around the hearing aid) to be modeled. However, in order to identify the common portion and the variant part from FBP measurements, the present disclosure describes a modeling approach that addresses a blind deconvolution problem within a Bayesian framework, resulting in a shorter adaptive FIR for the time varying part, and therefore faster convergence and significant reduction in computational load.

The present disclosure introduces constraints on the invariant part of a feedback path based on the prior knowledge to regularize the solution space and lessen the sensitivity to the initialization of the algorithm. Although the use of sparsity constraint has been a relevant choice for image processing applications, sparsity constraint alone is not sufficient in a hearing device application as it ignores the tail of the invariant part of the feedback path. While commonly assigned U.S. Published Patent Application No. 2017/0094421, entitled Dynamic Relative Transfer Function Estimation Using Structured Sparse Bayesian Learning, filed Sep. 23, 2016, to Ritwik et al., describes using prior information with sparsity for initial taps to model any common delay and high nonzero filter coefficients in a non-blind deconvolution problem of relative impulse response estimation, the present disclosure addresses the blind deconvolution in a Bayesian framework, and employs an Empirical Bayes based interference procedure to estimate the concerned filter coefficients.

For example, if L number of feedback paths (FBPs) have been measured for the same hearing aid on the same ear but with different acoustic scenarios, which can be denoted as bk[n] for, k=1, . . . , L, a key assumption is that, for all L measurements these FBPs have an invariant part, i.e. a fixed filter which accounts for the invariant properties of each measurement such as, fixed transducer, fixed mechanical and acoustic couplings and individual characteristics of that particular ear. Let f[n] and ek[n] denote the impulse response of the invariant part and the variant part of the $k^{th}$ FBP bk[n] respectively. Hence, $$bk[n]=f[n]*ek[n] \quad \text{Equation (1)}$$

In addition, the measurement of FBP may have some additive noise, which can also account for model uncertainty, and should be considered.

Hence, $$bk[n]=f[n]*ek[n]+E[n] \quad \text{Equation (2)}$$

The present disclosure incudes estimating the invariant part f[n] from the true measurements of L FBPs, bk[n].

Since blind deconvolution involves an infinite number of possible solutions, information about the structure of the invariant filter is required in order determine a unique optimal solution. Incorporating pole zero structure is one way to do that, but the problem with incorporating pole zero structure is the added concern to maintain stability (estimated pole location) and also sensitivity to noise. The present disclosure uses a FIR filter to model the invariant portion of the feedback path and provides an Empirical Bayes based approach with prior distribution, incorporating sparsity and exponentially decaying kernel to obtain a robust estimator of the common invariant portion of FBPs.

Because both f[n] and ek[n] in Equation (2) are unknown and need to be estimated from the true measurements of FBP, bk[n] of each length N, $$bk=[bk[0], \ldots, bk[N-1]]^T \in R^{N\times 1} \quad \text{Equation (3)}$$

Let's assume that f[n] can be modeled using an FIR of length C and each $e_k[n]$ using an FIR of length M, such that M+C−1≤N.

$$e_k=[e_k[0], \ldots, e_k[M-1]]^T \in \mathbb{R}^{M\times 1} \quad \text{Equation (4)}$$

$$f=[f[0], \ldots, f[C-1]]^T \in \mathbb{R}^{C\times 1} \quad \text{Equation (5)}$$

We also need to truncate the true FBP measurement up to length M+C−1 for the simulation stage, i.e., $$bk^{tr}=[bk[0], \ldots, bk[M+C-2]]^T \in R^{M+C-1\times 1} \quad \text{Equation (6)}$$

We can rewrite Equation (3) in matrix and vector product using convolution matrix and appending all the truncated FBP measurements $bk^{tr}$ together in a long column, the models can be rewritten, $$b=Ef+E \quad \text{Equation (7)}$$

Where E is the tall stacked matrix of the convolution matrices $Ek \in R^{M+C-1 \times C}$ constructed from ek, i.e., $$E=[E_1;E_2;\ldots E_L]\in R^{L(M+C-1)\times C} \quad \text{Equation (8)}$$

and, $$b=[b^{tr}{}_1{}^T \ldots b^{tr}{}_L{}^T]^T \in \mathbb{R}^{L(M+C-1)\times} \quad \text{Equation (9)}$$

Now in our probabilistic framework we will assume that the measurement noise is Gaussian with variance $\sigma^2$, which leads to the following likelihood distribution, $$p(b|f,e_1,\ldots,e_L;\sigma^2)\sim N(Ef,\sigma^2) \quad \text{Equation (10)}$$

If we assume that the noninformative flat priors have been employed over both the common f and variant part ek, then the MAP estimate of the unknown filters can be found by solving the following nonlinear optimization problem, $$\hat{f},\hat{e}k=\arg\min\|b-Ef\|^2 \quad \text{Equation (11)}$$

An Iterative Least Square (ILSS) approach has been used to solve this nonlinear problem by alternately estimating f and ek till convergence.

As discussed above, there are an infinite number of solutions possible for f and ek for blind deconvolution, which is one of the main reasons why ILSS suffers from severe sensitivity to initialization and often gets stuck to a local minimum. To regularize the problem and find a meaningful solution we need to incorporate some prior information in our Bayesian framework by enforcing a prior distribution on the unknown invariant filter coefficients.

In image processing applications of blind deconvolution, sparsity has been a popular regularization strategy to obtain meaningful solutions. However, sparsity assumption becomes too restrictive to model decaying nature of FBPs and often ignores the tail because of small coefficient values (close to zero). To counter this problem, the present disclosure also employs an exponential decaying kernel to model the tail and sparsity inducing prior constraints for initial few filter coefficients and a common delay. The prior distribution over f is proposed as follows:

$$p(f|\gamma,c_1,c_2)\sim N(0,\Gamma) \quad \text{Equation (12)}$$

With:

$$\Gamma=\text{diag}[\gamma_1,\ldots,\gamma_P,c_1e^{-c_2},\ldots,c_1e^{-c_2m},\ldots,c_1e^{-c_2M}] \quad \text{Equation (13)}$$

Where:

$\gamma_p$ corresponds to $p^{th}$ early tap $c_1e^{-c_2m}$ corresponds to $m^{th}$ tap out of the M exponentially decaying kernel $\gamma=[\gamma_1,\ldots,\gamma_P]$, $c_1$ and $c_2$ can be interpreted as the hyperparameters of the model, which can be learned from the measurements using an Evidence Maximization approach. Details of this inference procedure will be discussed below.

It is not straight forward to see from the above mentioned prior distribution p(fi|γi)=N(fi; 0, γi) for, i=1 . . . P, how the sparsity is enforced on the initial few taps of f, because the hierarchical nature of the prior disguises its character. To expand on this, let's assume that an Inverse Gamma (IG(α, β)) distribution has been used as the prior over hyperparameters. To find the "true" nature of the prior p(fi), we integrate out the γi and the marginal is obtained as, $$p(f_i)=\int p(f_i\mid\gamma_i)p(\gamma_i)d\gamma_i=\frac{\beta^\alpha\Gamma(\alpha+0.5)}{(2\pi)^{0.5}\gamma(\alpha)}\left(\beta+\frac{f_i^2}{2}\right)^{-(\alpha+0.5)} \quad \text{Equation (14)}$$

Figure 6:
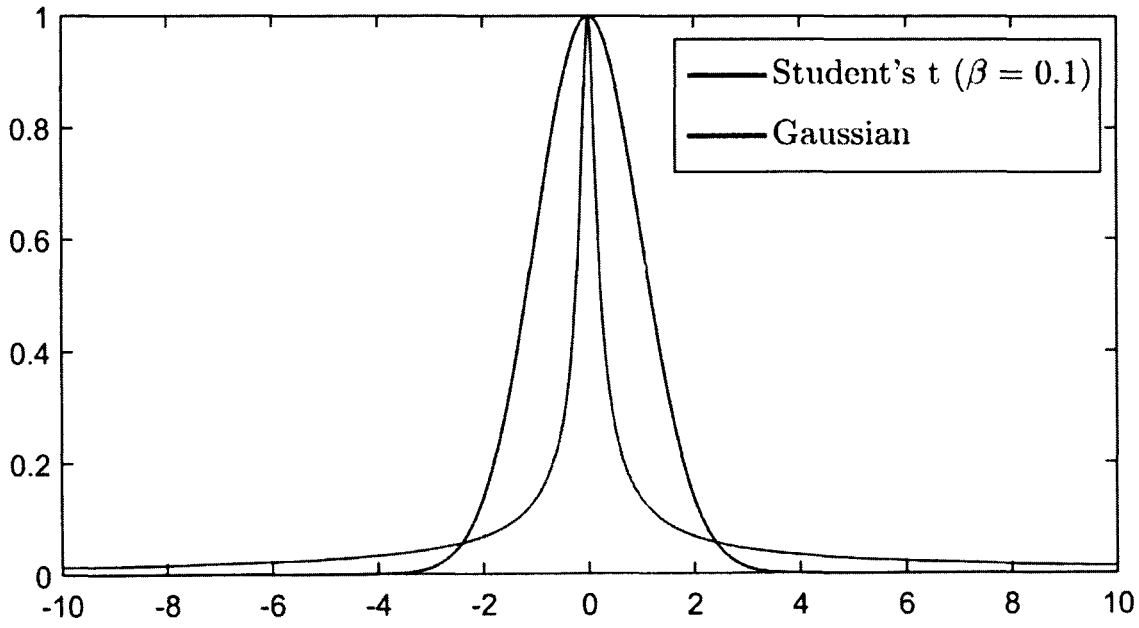
FIG. 6 are plots of a student's t-distribution with degrees of freedom (β)=0.1, and a Gaussian distribution.

This marginal distribution's "true" representation of the behavior of the prior of initial P taps of the common part corresponds to a Student's t-distribution, which is a super Gaussian density (has heavier tails than Gaussian) and has been very popular because of its ability to promote sparsity. In FIG. 6 we present the pdfs of a student's t-distribution with degrees of freedom (β)=0.1, and a Gaussian distribution to show why a student's distribution is suited to promote sparsity.

Since the variant part $e_k$ will be adapted during the Feedback Cancellation stage, the present disclosure employs a non-informative flat prior on $p(e_k)$ and proceeds to the inference stage.

Enforcing relevant prior distribution may not be enough to deal with the ill posed nature of the blind deconvolution problem, and discusses that the inference strategy to estimate the concerned parameters, should also be chosen with caution.

Straightforward estimation approach is to look for the Maximum a posteriori (MAP) estimate for both the common part f and the variant part e simultaneously, i.e. MAP f,e estimate, $$\hat{f},\hat{e}=\arg\max p(f,e|b) \quad \text{Equation (15)}$$

However, there are many problems with this straightforward simultaneous MAP estimation approach. One major problem is the presence of many suboptimal local minima which leads to convergence issues and hence sensitivity to initialization. To mitigate some of these issues, as suggested in [12] we will also use an Empirical Bayes based inference procedure also known as Type II/Evidence maximization for a well-conditioned estimate of the common part, f.

The present disclosure employs an EM algorithm for inference and treat ek as parameters and f as the hidden random variable. In the E step the concerned posterior is computed, p(f|b; E, γ, $c_1$, $c_2$).

Because of the Gaussian nature of both likelihood and prior distribution given in Equation (11), this step leads to the following Gaussian posterior, $$p(f|b:E,\gamma,c_1,c_2)=N(f;\mu,\Sigma) \quad \text{Equation (16)}$$

Where the mean and covariance are, $$\hat{f}=\mu=\sigma^{-2}\Sigma E^Tb \quad \text{Equation (17)}$$

$$\Sigma=(\sigma^{-2}E^TE+\Gamma^{-1})^{-1} \quad \text{Equation (18)}$$

Note that E is the stacked convolution matrix following Equation (10). The result from the E step is utilized to compute the Q function, which is essentially the conditional expectation of the complete data log likelihood with respect to the concerned posterior given in Equation (16).

$$Q(e_k,\gamma,c_1,c_2)=\mathbb{E}_{f|b;\gamma^t,c_1{}^t,c_2{}^t,\sigma^2,e_k}[\log(p(b|f;E,\sigma^2)p(f|\gamma,c_1,c_2))] \quad \text{Equation (19)}$$

In the Q function expression, the following conditional expectation is needed, $$\langle f_i^2\rangle=E_{f|b;\gamma^t,c_1{}^t,c_2{}^t,\sigma^2,e_k}[f_i^2]=\Sigma_{(i,i)}+\mu_i^2 \quad \text{Equation (20)}$$

Now in the M step the given Q function is maximized with respect to $e_k$, $c_1$, $c_2$, and γ, $$\hat{e}_k,\hat{\gamma},\hat{c}_1,\hat{c}_2=\arg\max_{e_k,\gamma,c_1,c_2} Q(e_k,\gamma,c_1,c_2) \quad \text{Equation (21)}$$

After maximizing the Q function, the following update rules are applied, $$\gamma_P = \Sigma_{(p,p)} + \mu_p^2 \text{ for } p = 1 \ldots P \quad \text{Equation (22)}$$

$$c_1 = \frac{1}{m}\sum_{m=1}^{M} e^{c_2 m} < f_{m+P}^2 > \quad \text{Equation (23)}$$

$$\sum_{m=1}^{M} m e^{c_2 m} < f_{m+P}^2 > - c_1 \frac{M(M+1)}{2} = 0 \quad \text{Equation (24)}$$

$$\hat{e}_k = \arg\min_{e_k} \left\| b_k^{tr} + \hat{F} e_k \right\|^2 + \sum_i w_i e_{k,i}^2 \quad \text{Equation (25)}$$

Where, wi=Σj Σi+j,i+j.

Note that the convolution matrix E in the update off in Equation (17) will be constructed from the most recent estimates of the variant part. Similarly when the variant parts ek are updated using Equation (25), the convolution matrix $\hat{F}$ is constructed using the recent estimate of f. These EM based updates are performed for a few iterations until a convergence criterion is satisfied. The present disclosure does not learn the noise variance $\sigma^2$ in the M step. Instead an annealing type strategy is employed where after every iteration the noise variance, $\sigma^2 \leftarrow \sigma^2/\beta$, where $\beta>1$ is updated until it reaches a prespecified minimum value ($\lambda$min). According to one example, $\beta=1.08$ and $\lambda$min=1e−10 are used. Intuition behind this annealing strategy is that, during initial iterations a high value of $\sigma^2$ prevents the algorithm from getting stuck to a local minimum and as the iteration number grows, decreasing $\sigma^2$, i.e., reducing the uncertainty will help our algorithm to converge to the global minima.

Figure 2:
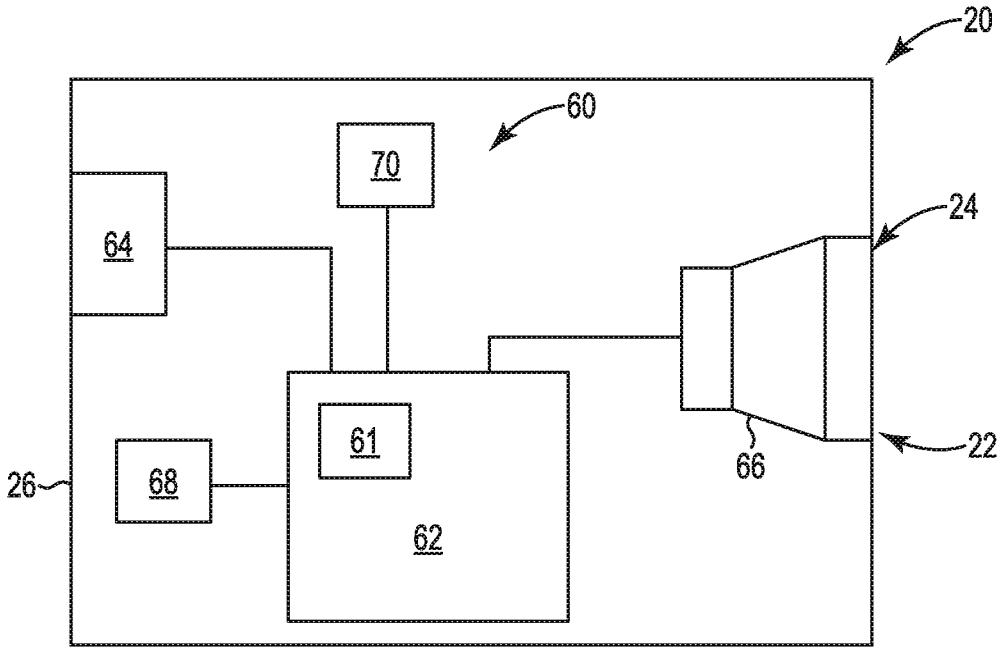
FIG. 2 is a schematic cross-section view of a housing of the hearing assistance device of FIG. 1.

FIGS. 1-2 are various views of one embodiment of a hearing assistance device 10. The device 10 can provide sound to an ear of a patient (not shown). The device 10 includes a housing 20 adapted to be worn on or behind the ear, hearing assistance components 60 enclosed in the housing, and an earmold 30 adapted to be worn in the ear. The device can also include a sound tube 40 adapted to transmit an acoustic output or sound from the housing 20 to the earmold 30, and an earhook 50 adapted to connect the housing to the sound tube. As used herein, the term "acoustic output" means a measure of the intensity, pressure, or power generated by an ultrasonic transducer.

In one or more embodiments, the sound tube 40 can be integral with the earmold 30. Further, the earmold 30, sound tube 40, and earhook 50 can together provide an earpiece 12.

The housing 20 can take any suitable shape or combination of shapes and have any suitable dimensions. In one or more embodiments, the housing 20 can take a shape that can conform to at least a portion of the ear of the patient. Further, the housing 20 can include any suitable material or combination of materials, e.g., silicone, urethane, acrylates, flexible epoxy, acrylated urethane, and combinations thereof.

Any suitable hearing assistance components can be enclosed in the housing 20. For example, FIG. 2 is a schematic cross-section view of the housing 20 of device 10 of FIG. 1. Hearing assistance components 60 are enclosed in the housing 20 and can include any suitable device or devices, e.g., integrated circuits, power sources, microphones, receivers, etc. For example, in one or more embodiments, the components 60 can include a processor 62, a microphone 64, a receiver 66 (e.g., speaker), a power source 68, and an antenna 70. The microphone 64, receiver 66, power source 68, and antenna 70 can be electrically connected to the processor 62 using any suitable technique or combination of techniques.

Any suitable processor 62 can be utilized with the hearing assistance device 10. For example, the processor 62 can be adapted to employ programmable gains to adjust the hearing assistance device output to a patient's particular hearing impairment. The processor 62 can be a digital signal processor (DSP), microprocessor, microcontroller, other digital logic, or combinations thereof. The processing can be done by a single processor, or can be distributed over different devices. The processing of signals referenced in this disclosure can be performed using the processor 62 or over different devices.

In one or more embodiments, the processor 62 is adapted to perform instructions stored in one or more memories 61. Various types of memory can be used, including volatile and nonvolatile forms of memory. In one or more embodiments, the processor 62 or other processing devices execute instructions to perform a number of signal processing tasks. Such embodiments can include analog components in communication with the processor 62 to perform signal processing tasks, such as sound reception by the microphone 64, or playing of sound using the receiver 66.

The hearing assistance components 60 can also include the microphone 64 that is electrically connected to the processor 62. Although one microphone 64 is depicted, the components 60 can include any suitable number of microphones. Further, the microphone 64 can be disposed in any suitable location within the housing 20. For example, in one or more embodiments, a port or opening can be formed in the housing 20, and the microphone 64 can be disposed adjacent the port to receive audio information from the patient's environment.

Any suitable microphone 64 can be utilized. In one or more embodiments, the microphone 64 can be selected to detect one or more audio signals and convert such signals to an electrical signal that is provided to the processor. Although not shown, the processor 62 can include an analog-to-digital convertor that converts the electrical signal from the microphone 64 to a digital signal.

Electrically connected to the processor 62 is the receiver 66. Any suitable receiver can be utilized. In one or more embodiments, the receiver 66 can be adapted to convert an electrical signal from the processor 62 to an acoustic output or sound that can be transmitted from the housing 60 to the earmold 30 and provided to the patient. In one or more embodiments, the receiver 66 can be disposed adjacent an opening 24 disposed in a first end 22 of the housing 20. As used herein, the term "adjacent the opening" means that the receiver 66 is disposed closer to the opening 24 disposed in the first end 22 than to a second end 26 of the housing 20.

The power source 68 is electrically connected to the processor 62 and is adapted to provide electrical energy to the processor and one or more of the other hearing assistance components 60. The power source 68 can include any suitable power source or power sources, e.g., a battery. In one or more embodiments, the power source 68 can include a rechargeable battery. In one or more embodiments, the components 60 can include two or more power sources 68.

The components 60 can also include the optional antenna 70. Any suitable antenna or combination of antennas can be utilized. In one or more embodiments, the antenna 70 can include one or more antennas having any suitable configuration. For example, antenna configurations can vary and can be included within the housing 20 or be external to the housing. Further, the antenna 70 can be compatible with any suitable protocol or combination of protocols. In one or more embodiments, the components 60 can also include a transmitter that transmits electromagnetic signals and a radio-frequency receiver that receives electromagnetic signals using any suitable protocol or combination of protocols.

Returning to FIG. 1, the earmold 30 can include any suitable earmold and take any suitable shape or combination of shapes. In one or more embodiments, the earmold 30 includes a body 32 and a sound hole 34 disposed in the body. The sound hole 34 can be disposed in any suitable location in the body 32 of the earmold 30. The sound hole 34 can be disposed in an upper portion 38 of the body 32 and extend through the body and to an opening (not shown) at a first end 36 of the body. The sound hole 34 can be adapted to transmit sound from the sound tube 40 through the body 32 of the earmold 30 such that the sound exits the opening at the first end 36 of the body and is, therefore, transmitted to the patient.

The body 32 of the earmold 30 can take any suitable shape or combination of shapes. In one or more embodiments, the body 32 takes a shape that is compatible with a portion or portions of the ear cavity of the patient. For example, the first end 36 of the body 32 can be adapted to be inserted into the ear canal of the patient.

The earmold 30 can include any suitable material or combination of materials, e.g., silicone, urethane, acrylates, flexible epoxy, acrylated urethane, and combinations thereof.

Further, the earmold 30 can be manufactured using any suitable technique or combination of techniques as is further described herein.

Connected to the earmold 30 is the sound tube 40. The sound tube 40 can be adapted to transmit sound from the housing 20 to the earmold 30. For example, in one or more embodiments, sound can be provided by the receiver 66 and directed through the sound tube 40 to the earmold 30. Such acoustic output can then be directed by the earmold 30 through the sound hole 34 such that the acoustic output is directed through the opening at the first end 36 of the body 32 of the earmold and to the patient.

The sound tube 40 can take any suitable shape or combination of shapes and have any suitable dimensions. In one or more embodiments, the sound tube 40 has a substantially circular cross-section along a length of the sound tube. In one or more embodiments, the cross-section of the sound tube 40 is constant in a direction along the length of the sound tube. Further, in one or more embodiments, the cross-section of the sound tube 40 varies in the direction along the length. Further, an inner diameter of the sound tube 40 can have any suitable dimensions. In one or more embodiments, the inner diameter of the sound tube 40 can be equal to at least 0.5 mm and no greater than 5 mm. In one or more embodiments, the sound tube 40 can have any suitable length. In one or more embodiments, the length of the sound tube 40 is at least 1 mm and no greater than 100 mm.

The sound tube 40 can take any suitable shape or combination of shapes. In one or more embodiments, the sound tube 40 can take a shape that is tailored to follow the anatomy of the patient's ear from the earmold 30 that is inserted at least partially within the inner canal of the patient, around a front edge of the pinna of the patient's ear, and to the earhook 50 of the device 10. In one or more embodiments, one or both of the shape and dimension of the sound tube 40 can be tailored to a specific patient's anatomy. In one or more embodiments, the sound tube 40 can be integral with the earhook 50.

The sound tube 40 can include any suitable material or materials, e.g., the same materials utilized for the earmold 30. In one or more embodiments, the sound tube 40 can include a material or materials that are different from those of the earmold 30.

The sound tube 40 can be connected to the earmold 30 using any suitable technique or combination of techniques. In one or more embodiments, a first end 42 of the sound tube 40 is connected to the sound hole 34 of the earmold 30 by inserting the first end into the sound hole. In one or more embodiments as is further described herein, the sound tube 40 is integral with the earmold 30 such that the first end 42 of the sound tube is aligned with and acoustically connected to the sound hole 34 of the earmold. As used herein, the term "acoustically connected" means that two or more elements or components are connected such that acoustical information (e.g., acoustic output or sound) can be transmitted between the two or more elements or components. For example, the sound tube 40 is integral with the earmold 30 such that sound can be transmitted between the sound tube and earmold.

In one or more embodiments, the sound tube 40 can be directly connected to the housing 20 such that the sound tube acoustically connects the housing to the earmold 30. In one or more embodiments, the device 10 can include the earhook 50 that is adapted to connect the housing 20 to the sound tube 40. Any suitable earhook 50 can be utilized with the device 10. Further, the earhook 50 can have any suitable dimensions and take any suitable shape or combination of shapes. In one or more embodiments, the earhook 50 takes a curved shape such that the earhook follows the forward or front edge of the pinna of the patient's year.

The earhook 50 can include any suitable material or materials, e.g., the same materials utilized for the earmold 30. In one or more embodiments, the earhook 50 can include a material or materials that are different from the materials utilized for the earmold 30. Further, for example, the earhook 50 can include a material or materials that are the same as or different from the materials utilized for the sound tube 40.

The earhook 50 can be connected to the sound tube 40 using any suitable technique or combination of techniques. For example, in one or more embodiments, a second end 54 of the earhook 50 is connected to a second end 44 of the sound tube 40 using any suitable technique or combination of techniques. In one or more embodiments, the second end 54 of the earhook 50 is friction fit either over or within the second end 44 of the sound tube 40.

The earhook 50 can be connected to the housing 20 using any suitable technique or combination of techniques. In one or more embodiments, the earhook 50 can include one or more threaded grooves disposed on an inner surface of the first end 52 of the earhook that can be threaded onto threaded grooves formed on the first end 22 of the housing 20.

The device 10 can also include an extension tube (not shown) that connects the sound tube 40 to the earhook 50. Any suitable extension tube can be utilized. In one or more embodiments, the extension tube acoustically connects the sound tube 40 to the earhook 50.

The earmold 30, sound tube 40, and earhook 50 can, in one or more embodiments, provide the earpiece 12. As mentioned herein, two or more of the earmold 30, sound tube 40, and earhook 50 can be integral. For example, in one or more embodiments, the earhook 50 is integral with the sound tube 40, e.g., the second end 54 of the earhook is integral with the second end 44 of the sound tube. Further, in one or more embodiments, the sound tube 40 can be integral with the earmold 30, e.g., the first end 42 of the sound tube can be integral with the earmold.

The hearing assistance device 10 can include an optional coating disposed on one or more of the housing 20, earmold 30, sound tube 40, and earhook 50. Further, the coating can include any suitable material or materials.

In one or more embodiments, the coating can provide various desired properties. For example, the coating can include a hydrophobic, hydrophilic, oleophobic, or oleophilic material. In one or more embodiments, the optional coating can include a textured coating to provide the patient with one or more gripping surfaces such that the patient can more easily grasp a portion or portions of the earpiece 12 and dispose the earmold 30 within the ear cavity.

The device 10 of FIGS. 1-2 can be manufactured using any suitable technique or combination of techniques. For example, forming of the hearing assistance device 10 may include forming a three-dimensional model of an ear cavity of the patient. In one or more embodiments, the ear cavity can include any suitable portion of the ear canal, e.g., the entire ear canal. Similarly, the ear cavity can include any suitable portion of the pinna. Any suitable technique or combination of techniques can be utilized to form the three-dimensional model of the ear cavity of the patient. In one or more embodiments, a mold of the ear cavity can be taken using any suitable technique or combination of techniques. Such mold can then be scanned using any suitable technique or combination of techniques to provide a digital representation of the mold.

In one or more embodiments, the ear cavity of the patient can be scanned using any suitable technique or combination of techniques to provide a three-dimensional digital representation of the ear cavity without the need for a physical mold of the ear cavity.

A three-dimensional model of the earmold 30 based upon the three-dimensional model of the ear cavity of the patient can be formed. Any suitable technique or combination of techniques can be utilized to form the three-dimensional model of the earmold 30.

A three-dimensional model of the sound tube 40 can be formed using any suitable technique or combination of techniques. In one or more embodiments, the three-dimensional model of the sound tube 40 can be added to the three-dimensional model of the earmold 30 such that that the sound tube model and the earmold model are integral. In one or more embodiments, the three-dimensional model of the sound tube 40 is aligned with the sound hole 34 of the three-dimensional model of the earmold 30.

The completed earpiece 12 can be connected to the housing 20 by connecting the first end 52 of the earhook 50 to the first end 22 of the housing 20 of the device 10 using any suitable technique or combination of techniques.

Figure 3:
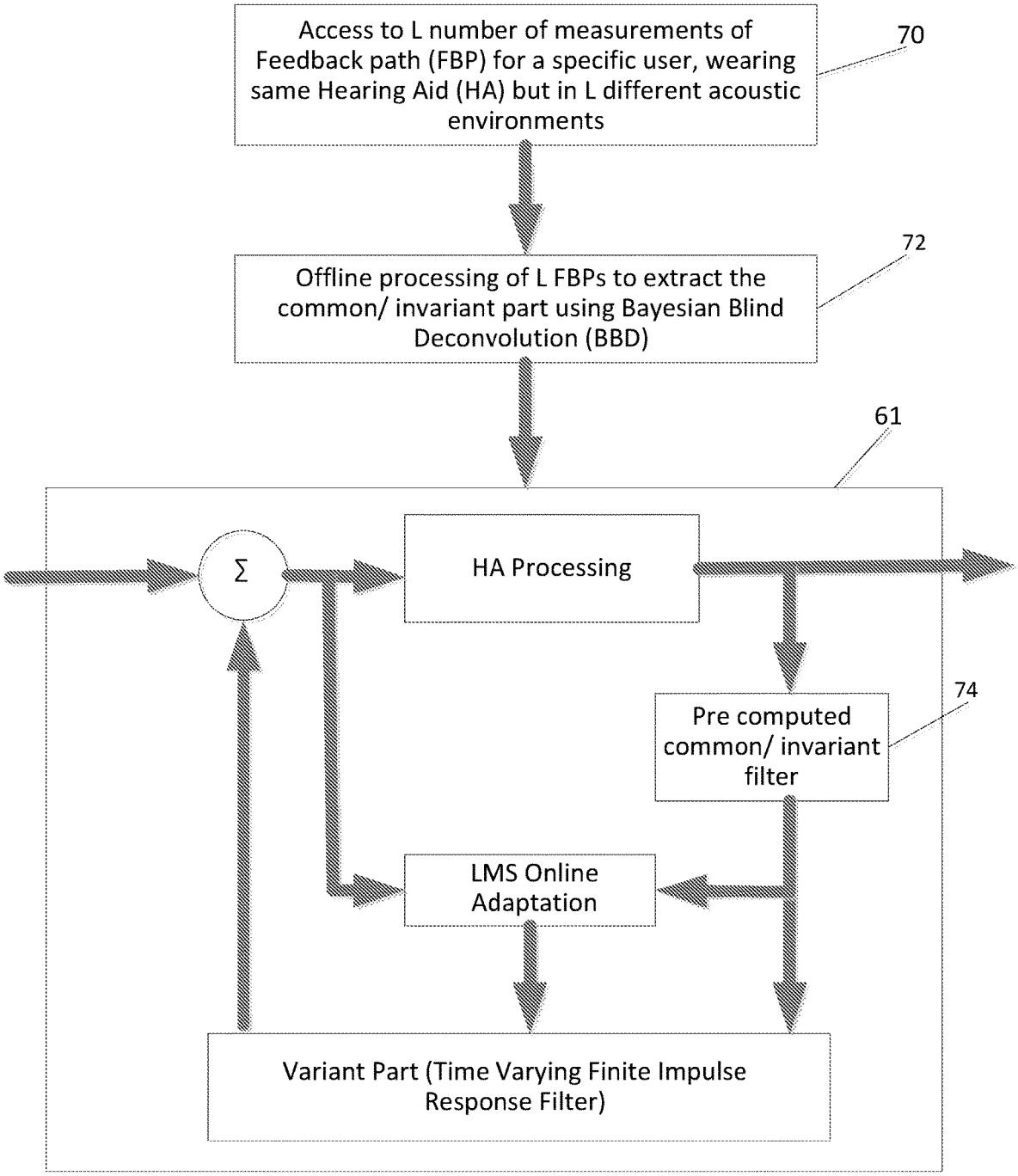
FIG. 3 is a schematic diagram of filtering of a feedback signal in a hearing assistance device according to an embodiment of the present disclosure.

FIG. 3 is a schematic diagram of filtering of a feedback signal in a hearing assistance device according to an embodiment of the present disclosure. As illustrated in FIG. 3, during a training stage associated with the device 10, offline processing by a processor is used to measure L number of feedback signals from L feedback paths for a specific user, wearing the same hearing assistance device 10 but in L different acoustic environments, Block 70. Offline processing of the acoustic signals of the L feedback paths is used to determine a common or invariant portion using Bayesian Blind Deconvolution (BBD), Block 72, described below in detail. The determined common portion is stored in processor 61 of device 10 and used as a filter 74 to extract the unwanted feedback signal from the audio output by the device 61 for runtime feedback cancellation.

Figure 4:
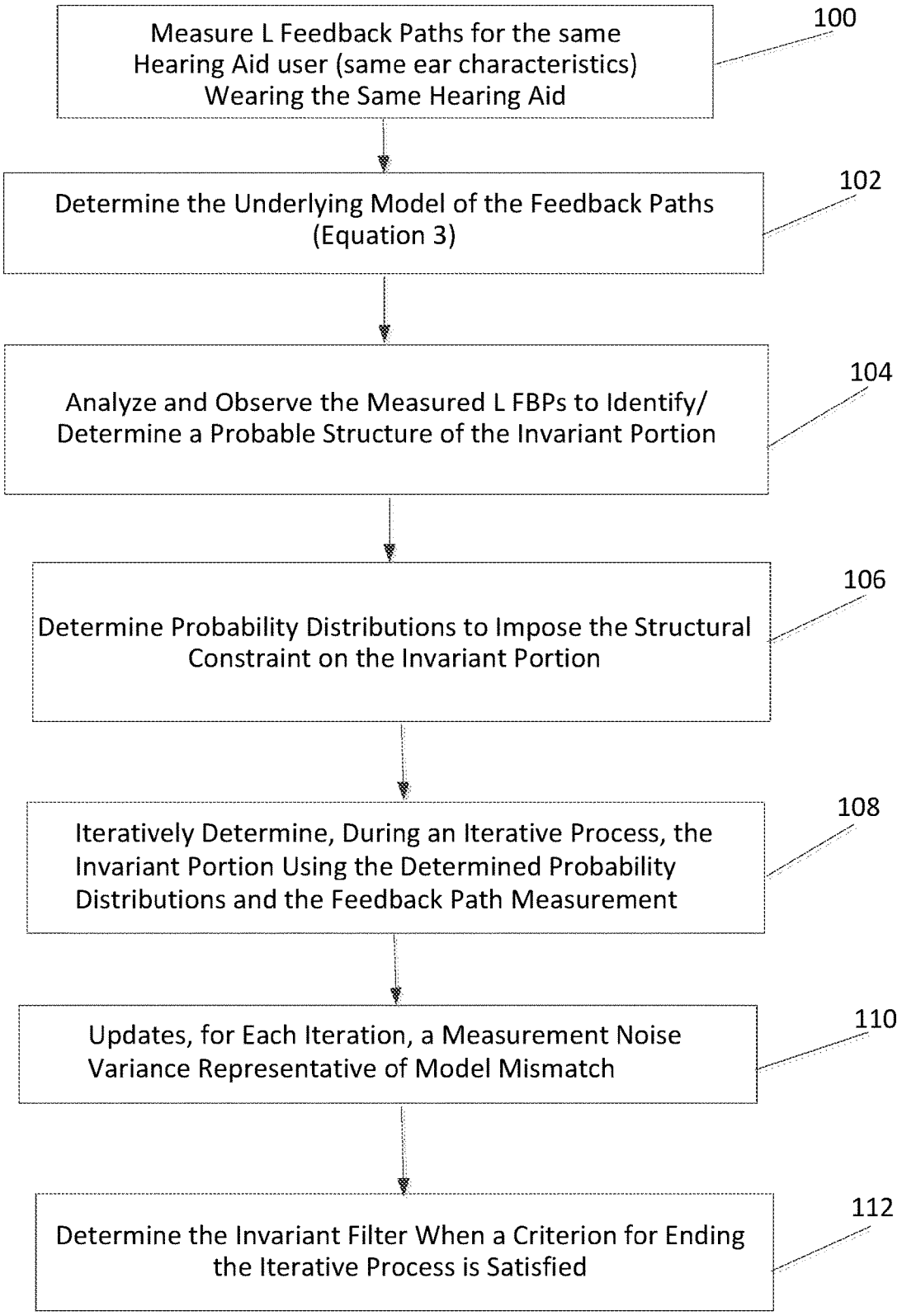
FIG. 4 is a flowchart of a method of determining filtering of a feedback signal in a hearing assistance device according to an embodiment of the present disclosure.

FIG. 4 is a flowchart of a method of determining filtering of a feedback signal in a hearing assistance device according to an embodiment of the present disclosure. As illustrated in FIG. 4, according to one embodiment of the present disclosure, in order to determine a filter to cancel feedback signals from input signals in a hearing assistance device, the processor uses the L feedback path measurements associated with the device 10, Block 100. The processor determines a model of the L feedback paths, using Equation (2) as described above, with the model including an invariant portion and a time varying portion, Block 102, and analyzes and observes the L feedback path measurements and determines a probable structure of the invariant portion, Block 104, to generate a structural constraint, which can be imposed during the estimation stage to deal with the problem of there being an infinite number of possible solutions for the invariant portion.

Figure 5:
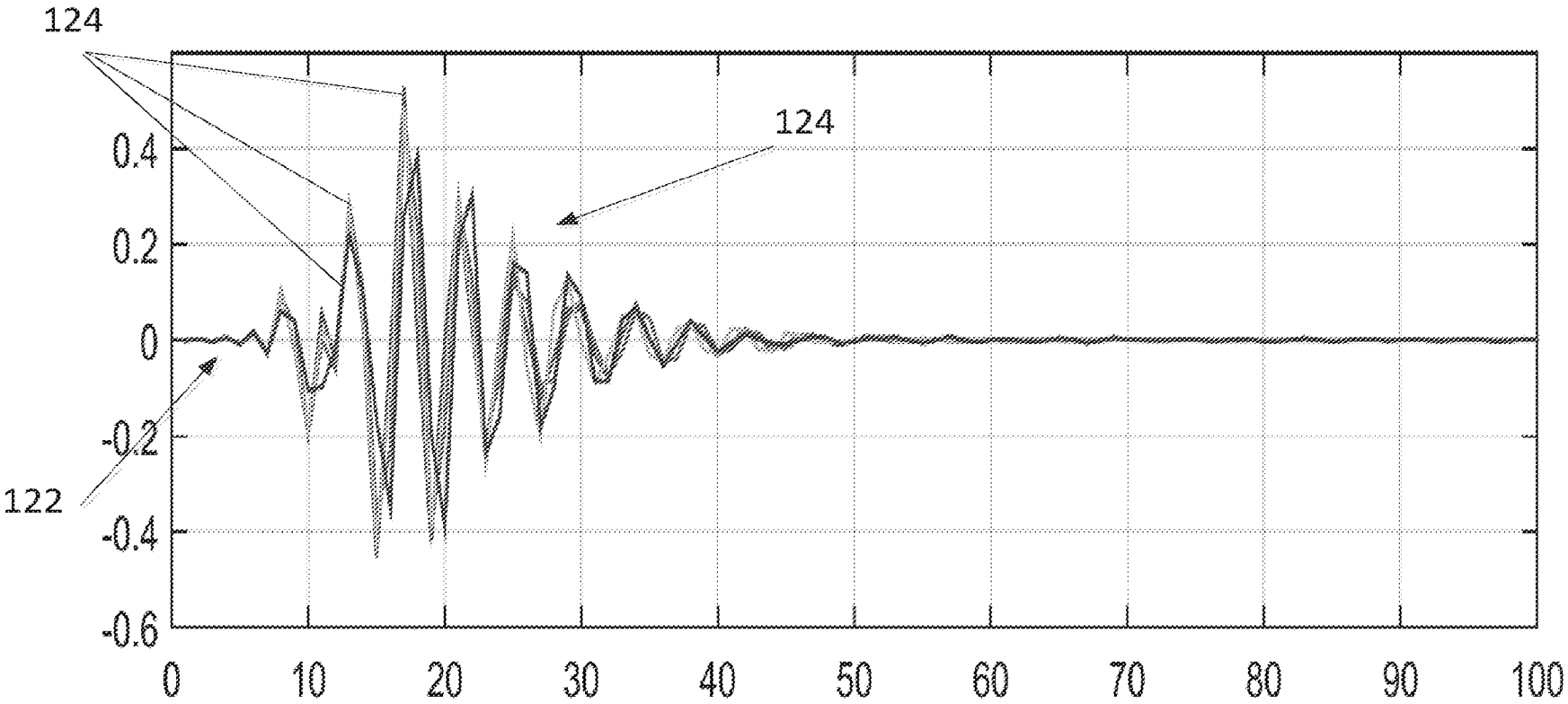
FIG. 5 is a plot of signals from four training feedback paths over time to illustrate an example of extracting an invariant portion according to an embodiment of the present disclosure.

FIG. 5 is a plot of signals from four training feedback paths over time to illustrate an example of extracting an invariant portion according to an embodiment of the present disclosure. For example, as illustrated in FIG. 5, in order to determine a probable structure of the invariant portion, the processor identifies certain common empirical or structural observations of feedback signals 120 associated with a predetermined number of the L feedback paths, such as there being a delay 122 in each of the feedback signals, or there being a certain decay 124 associated with the feedback signals for the predetermined feedback paths, or there being portions of the signals that are similar, such as the portion between 10 and 30 taps. In this way, the empirical observations reduce the number of possible solutions for determining the possible structure of the invariant portion, and the extracted common portion from the training feedback paths is then used to model the unseen test feedback path, as described below.

Returning to FIG. 4, the processor determines probability distributions to impose the structural constraint on the invariant portion, Block 106, with all other required probability distributions (such as likelihood) to characterize the Bayesian Model, using Equations (12), (13), and (10) as described above, and iteratively determines, during an iterative process, the invariant portion using the determined probability distributions and the feedback path measurements, Block 108. For example, the processor may develop an Expectation Maximization (EM) based iterative algorithm, which maximizes the posterior distribution (seeks MAP estimate) to estimate the common/invariant portion, using Equations (16)-(25) described above.

The processor updates, for each iteration, a measurement noise variance representative of model mismatch, to reduce a probability of a suboptimal, or non-desirable determination of an invariant filter, Block 110. For example, during iterative updates of the EM algorithm, an annealing strategy may be employed to reduce uncertainty of the underlying model over iterations, which in turn prevents the algorithm from getting stuck to a local minimum. The processor then determines the invariant filter in response to a criterion for ending the iterative process being satisfied, Block 112. For example, after a predetermined number of iterations, or any other meaningful stopping criteria, the EM algorithm may be stopped, and the point estimate of the common portion becomes the invariant filter, which is then sent to the device 10 for run time feedback cancellation.

All references and publications cited herein are expressly incorporated herein by reference in their entirety into this disclosure, except to the extent they may directly contradict this disclosure. Illustrative embodiments of this disclosure are discussed and reference has been made to possible variations within the scope of this disclosure. These and other variations and modifications in the disclosure will be apparent to those skilled in the art without departing from the scope of the disclosure, and it should be understood that this disclosure is not limited to the illustrative embodiments set forth herein. Accordingly, the disclosure is to be limited only by the claims provided below.

What is claimed is:

1. A method of determining a filter to cancel feedback signals from input signals in a hearing assistance device, comprising:

measuring a plurality of feedback paths associated with the device;

determining a model of the plurality of feedback paths, the model comprising an invariant portion and a time varying portion;

determining a probable structure of the invariant portion to generate a structural constraint to constrain the plurality of feedback paths;

determining probability distributions to impose the structural constraint on the invariant portion;

iteratively determining, during an iterative process, the invariant portion using the determined probability distributions and the feedback path measurements;

updating, for each iteration, a measurement noise variance representative of model mismatch, to reduce a probability of a non-desirable determination of an invariant filter; and determining the invariant filter in response to a criterion for ending the iterative process being satisfied.

2. The method of claim 1, wherein determining a probable structure of the invariant portion comprises determining empirical characteristics of a predetermined number of feedback paths of the plurality of feedback paths.

3. The method of claim 2, wherein the empirical characteristics comprise at least one of a delay associated with the invariant portion of the predetermined number of feedback paths, sparse filter coefficients and an exponential decay characteristics of filter tail associated with the invariant portion of the predetermined number of feedback paths.

4. The method of claim 3, wherein determining a prior probability distribution for the structural constraint comprises determining at least one of a sparsity associated with an early part of the invariant portion and an exponential decay of the filter coefficients associated with the tail of the invariant portion.

5. The method of claim 4, further comprising utilizing a Gaussian Scale Mixture distribution to impose the structural constraint in a predetermined number of filter coefficients of the invariant portion.

6. The method of claim 5, further comprising imposing the exponential decay by parametrizing later elements of a covariance matrix of the Gaussian Scale Mixture distribution associated with tail coefficients of the invariant portion.

7. The method of claim 6, wherein parametrizing later elements of a covariance matrix associated with tail coefficients of the invariant portion comprises utilizing $c_1$ and $c_2$ of $p(f|\gamma,c_1,c_2)\sim N(0,\Gamma)$, wherein $$\Gamma=\mathrm{diag}[\gamma_1, \ldots, \gamma_P, c_1e^{-c_2m}, \ldots, c_1e^{-c_2M}].$$

8. The method of claim 1, wherein iteratively determining the invariant portion from the determined probability distributions and feedback path measurements comprises utilizing an Expectation Maximum based iterative process.

9. The method of claim 1, wherein updating, for each iteration, a measurement noise variance representative of model mismatch comprises employing a simulated annealing strategy to reduce the probability of a non-desirable determination of the invariant filter to achieve convergence to a global optima.

10. The method of claim 9, wherein a value of the model mismatch is decreased using $$\sigma^2 = \frac{\sigma^2}{\beta},$$

where $\beta=1.08$ until the model mismatch reaches a predetermined minimum value.

11. The method of claim 1, wherein the criterion for ending the iterative process comprises a predetermined number of iterations being performed prior to determine the invariant filter.

12. A system of determining a filter to cancel feedback signals from input signals, comprising:

a hearing assistance device for processing acoustics signals; and a processor configured to:

measure a plurality of feedback paths associated with the device;

determine a model of the plurality of feedback paths, the model comprising an invariant portion and a time varying portion;

determine a probable structure of the invariant portion to generate a structural constraint to constrain the plurality of feedback paths;

determine probability distributions to impose the structural constraint on the invariant portion;

iteratively determine, during an iterative process, the invariant portion using the determined probability distributions and the feedback path measurements;

update, for each iteration, a measurement noise variance representative of model mismatch, to reduce a probability of a non-desirable determination of an invariant filter; and determine the invariant filter in response to a criterion for ending the iterative process being satisfied.

13. The system of claim 12, wherein determining a probable structure of the invariant portion comprises determining empirical characteristics of a predetermined number of feedback paths of the plurality of feedback paths.

14. The system of claim 13, wherein the empirical characteristics comprise at least one of a delay associated with the invariant portion of the predetermined number of feedback paths, sparse filter coefficients and an exponential decay characteristic of filter tail associated with the invariant portion of the predetermined number of feedback paths.

15. The system of claim 14, wherein determining a prior probability distribution for the structural constraint comprises determining at least one of a sparsity associated with an early part of the invariant portion and an exponential decay of the filter coefficients associated with the tail of the invariant portion.

16. The system of claim 15, wherein the processor is configured to utilize a Gaussian Scale Mixture distribution to impose the constraint in a predetermined number of filter coefficients of the invariant portion.

17. The system of claim 16, wherein the processor is configured to impose the exponential decay by parametrizing later elements of a covariance matrix associated with tail coefficients of the invariant portion.

18. The system of claim 17, wherein parametrizing later elements of a covariance matrix associated with tail coefficients of the invariant portion comprises utilizing $c_1$ and $c_2$ of $p(f|\gamma,c_1,c_2)\sim N(0,\Gamma)$, wherein $$\Gamma=\mathrm{diag}[\gamma_1, \ldots, \gamma_P, c_1e^{-c_2}, \ldots, c_1e^{-c_2m}, \ldots, c_1e^{-c_2M}].$$

19. The system of claim 12, wherein iteratively determining the invariant portion from the determined probability distribution and feedback path measurements comprises utilizing an Expectation Maximum based iterative process.

20. The system of claim 12, wherein updating, for each iteration, a measurement noise variance representative of model mismatch comprises employing a simulated annealing strategy to reduce the probability of a non-desirable determination of the invariant filter to achieve convergence to a global optima.

21. The system of claim 20, wherein a value of the model mismatch is decreased using $$\sigma^2 = \frac{\sigma^2}{\beta},$$

where $\beta=1.08$ until the model mismatch reaches a predetermined minimum value.

22. The system of claim 12, wherein the criterion for ending the iterative process comprises a predetermined number of iterations being performed prior to determining the invariant filter.

* * * * *